US010330427B2

(12) United States Patent
Shaffer et al.

(10) Patent No.: US 10,330,427 B2
(45) Date of Patent: Jun. 25, 2019

(54) MID-LIMB CAM CROSSBOW SYSTEM

(71) Applicant: Hunter's Manufacturing Company, Inc., Suffield, OH (US)

(72) Inventors: Michael Shaffer, Mogadore, OH (US); Dean Mook, Suffield, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 15/871,199

(22) Filed: Jan. 15, 2018

(65) Prior Publication Data

US 2018/0202748 A1 Jul. 19, 2018

Related U.S. Application Data

(60) Provisional application No. 62/446,035, filed on Jan. 13, 2017.

(51) Int. Cl.
*F41B 5/12* (2006.01)

(52) U.S. Cl.
CPC ..... *F41B 5/123* (2013.01)

(58) Field of Classification Search
CPC ..... F41B 5/10; F41B 5/12
See application file for complete search history.

(56) References Cited

U.S. PATENT DOCUMENTS 2,092,361 A 9/1937 Shim
3,043,287 A 7/1962 Nelson
3,561,419 A 2/1971 Cucuzza, Sr.
3,670,711 A 6/1972 Firestone
3,739,765 A 6/1973 Moore
4,192,281 A 3/1980 King
4,246,883 A 1/1981 Ash
4,593,675 A 6/1986 Waiser
4,603,676 A 8/1986 Luoma
4,649,892 A 3/1987 Bozek
4,662,345 A 5/1987 Stephens
4,665,885 A 5/1987 Glomski et al.
4,719,897 A 1/1988 Gaudreau
(Continued)

OTHER PUBLICATIONS

A Guide to the Crossbow, by W.F. Paterson, published by the Society of Archer-Antiquaries, 1990.

(Continued)

*Primary Examiner* — John A Ricci
(74) *Attorney, Agent, or Firm* — Emerson Thomson Bennett, LLC

(57) ABSTRACT

Provided is a mid-limb cam crossbow system comprising a beam; a bow assembly having a first bow limb of length L1 and second bow limb of length L2; a first cam engaged with the first bow limb at a point between (0.15)L1 and (0.75)L1 from the limb end; a second cam engaged with the second bow limb at a point between (0.15)L2 and (0.75)L2 from the limb end; a first power string engaged with the first cam and a region on the second bow limb greater than (0.75)L2 from the limb end; a second power string engaged with the second cam and a region on the first bow limb greater than (0.75)L1 from the limb end; and a bowstring engaged between the first cam and the second cam. The bow assembly may be configured in an uncocked configuration or a cocked configuration. L1 and L2 are between 15 centimeters and 65 centimeters.

20 Claims, 3 Drawing Sheets

(56) References Cited

U.S. PATENT DOCUMENTS

| | | | | |
|---|---|---|---|---|
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,624,725 | B1 | 12/2009 | Choma | |
| 7,784,453 | B1 | 8/2010 | Yehle | |
| 8,443,790 | B2 | 5/2013 | Pestrue | |
| 8,499,753 | B2 | 8/2013 | Bednar | |
| 9,255,753 | B2 * | 2/2016 | Pulkrabek | F41B 5/105 |
| 10,018,442 | B1 * | 7/2018 | Kempf | F41B 5/123 |
| 2006/0086346 | A1 | 4/2006 | Middleton | |
| 2010/0170488 | A1 | 1/2010 | Rasor et al. | |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

MID-LIMB CAM CROSSBOW SYSTEM

CROSS-REFERENCE TO RELATED APPLICATIONS

This application claims the benefit of U.S. Provisional Application No. 62/446,035, filed Jan. 13, 2017, the entirety of each of which are fully incorporated by reference herein.

BACKGROUND

The present subject matter is directed to apparatuses and methods regarding crossbows. More specifically the present subject matter is directed to apparatuses and methods for a crossbow having one or cams supported along a limb offset from either end of the limb.

Crossbows have been used for many years as a weapon for hunting and fishing, and for target shooting. Typically, a crossbow may include a beam including a stock member and a barrel connected to the stock member. The barrel typically has an arrow receiving area for receiving an arrow to be shot. The crossbow may also include a bow assembly supported on the main beam that includes a bow and a bowstring connected to the bow for use in shooting arrows. A trigger mechanism, also supported on the main beam, holds the bowstring in a drawn or cocked condition and can thereafter be operated to release the bowstring out of the uncocked condition to shoot the arrow.

The configuration of the bow and bowstring strongly influence the energy storage capacity of the bow and the energy and power output of the crossbows. It remains desirable to produce a compact bow having sufficient energy storage capacity, energy and power output, and other defining operational characteristics.

SUMMARY

Provided is a mid-limb cam crossbow system comprising a beam; a bow assembly having a first bow limb of length L1 and second bow limb of length L2; a first cam engaged with the first bow limb at a point between (0.15)L1 and (0.75)L1 from the limb end; a second cam engaged with the second bow limb at a point between (0.15)L2 and (0.75)L2 from the limb end; a first power string engaged with the first cam and a region on the second bow limb greater than (0.75)L2 from the limb end; a second power string engaged with the second cam and a region on the first bow limb greater than (0.75)L1 from the limb end; and a bowstring engaged between the first cam and the second cam. The bow assembly may be configured in an uncocked configuration or a cocked configuration. L1 and L2 are between 15 centimeters and 65 centimeters.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
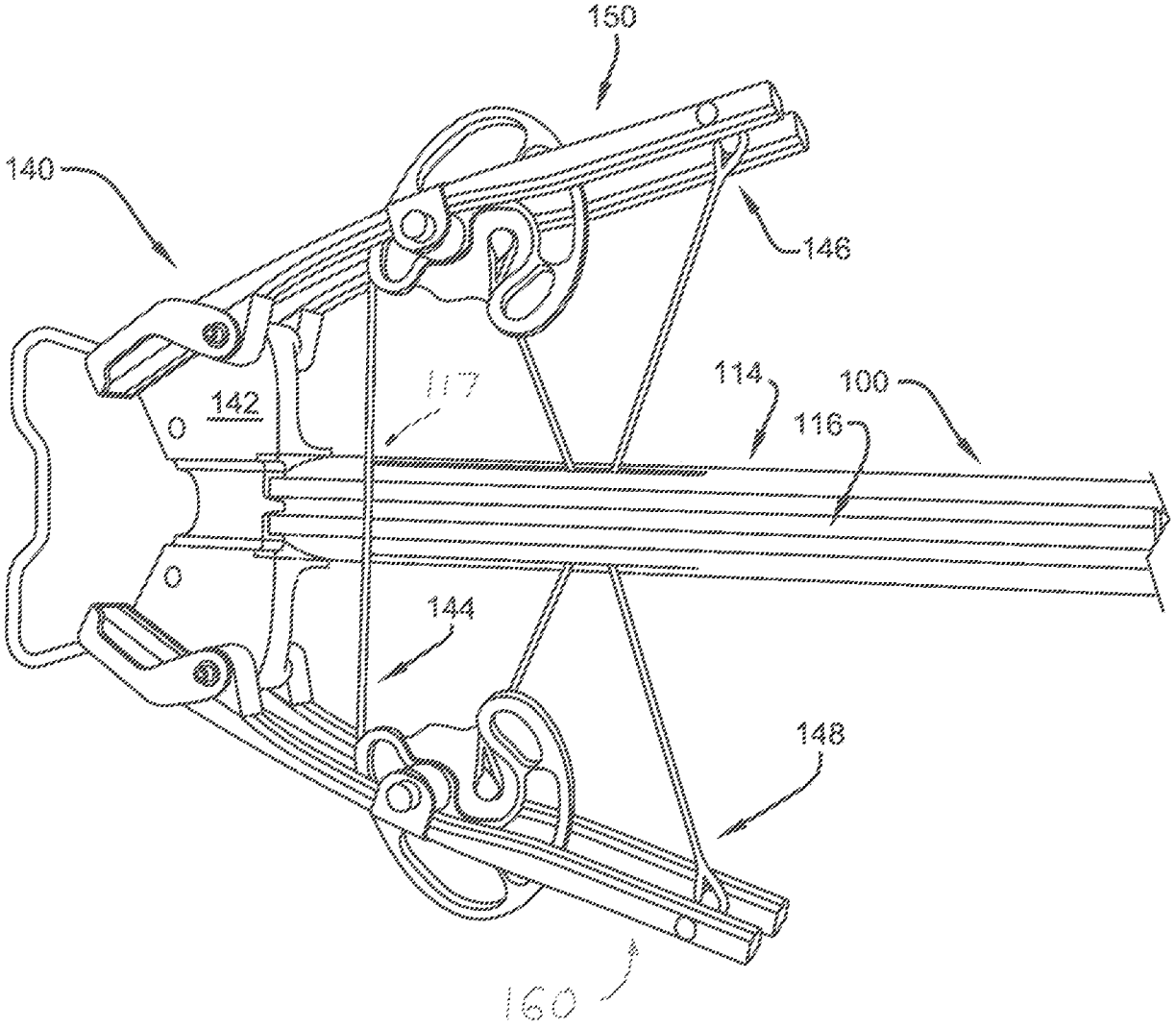
FIG. 1 is a top view of one embodiment of a crossbow comprising a mid-limb cam crossbow system.
Figure 2:
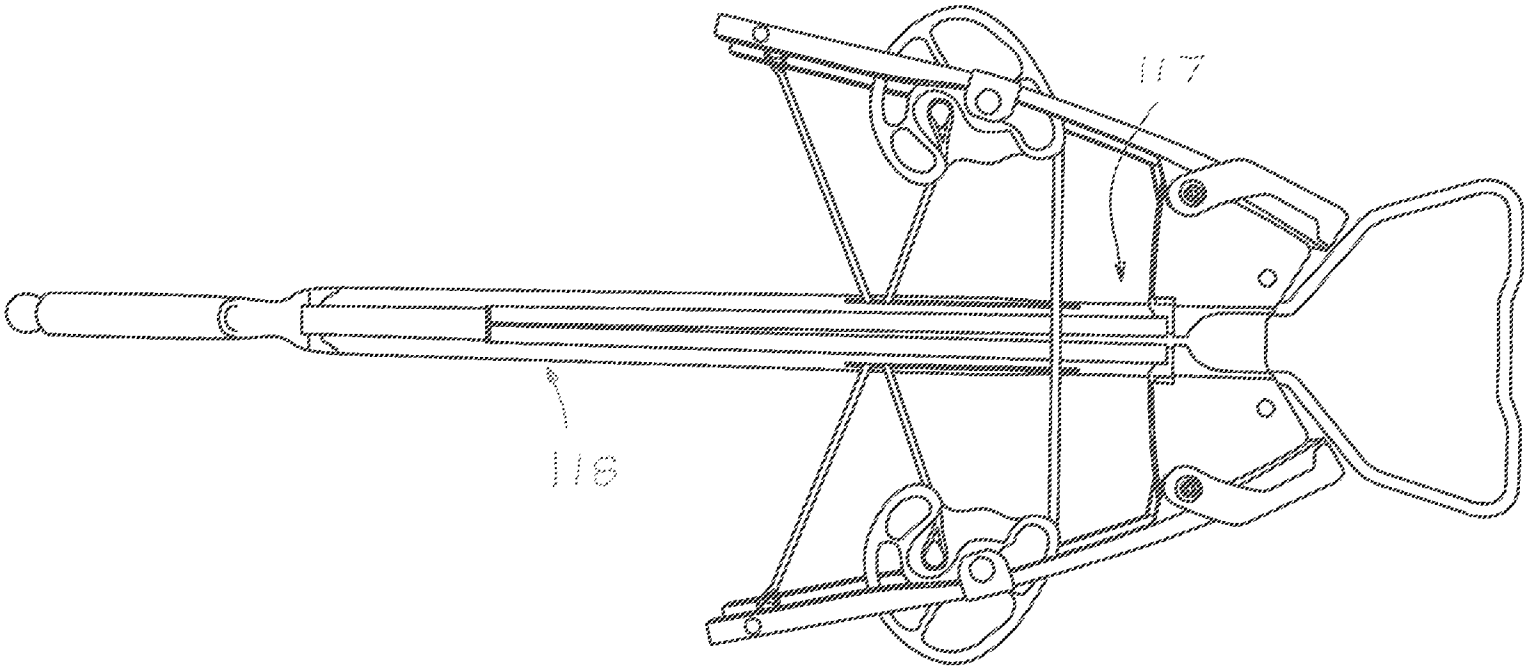
FIG. 2 is another top view of the embodiment of FIG. 1 of a crossbow comprising a mid-limb cam crossbow system.
Figure 3:
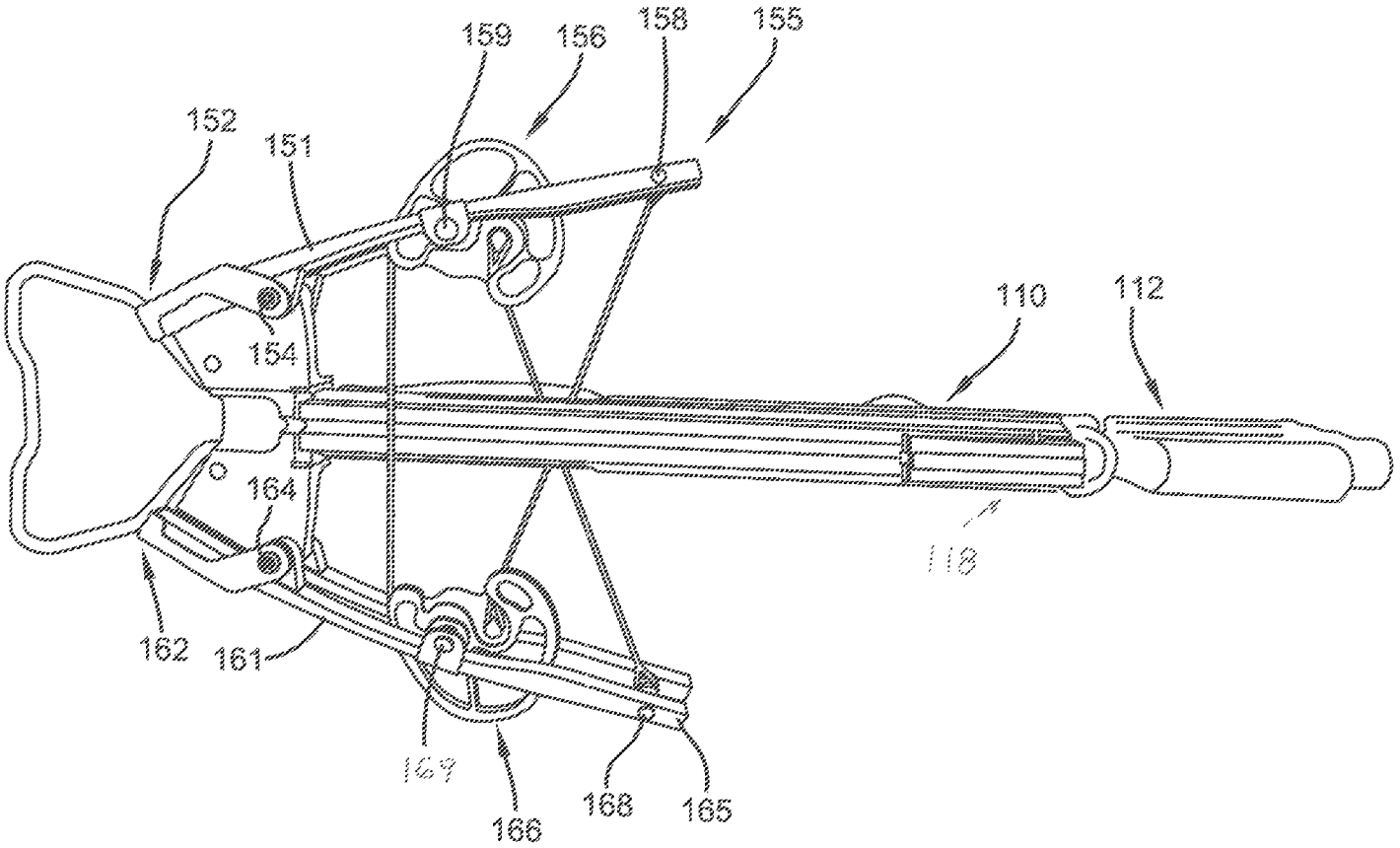
FIG. 3 is another top view of the embodiment of FIG. 1 of a crossbow comprising a mid-limb cam crossbow system.

Referring now to the drawings wherein the showings are for purposes of illustrating embodiments of the present subject matter only and not for purposes of limiting the same, and wherein like reference numerals are understood to refer to like components, provided is a mid-limb cam crossbow system and a method for using same.

In a first embodiment, a mid-limb cam crossbow system 100 may comprise a beam 110 and a bow assembly 140.

In the first embodiment, the beam 110 may be elongated. The beam 110 may include a stock member 112, and a barrel 114. The barrel 114 may be connected to the stock member 112. The barrel 114 may have an arrow receiver region 116 adapted to receive an associated arrow (not shown). The beam 110 may have a first beam end 117 and a second beam end 118 opposite the first beam end 117.

The bow assembly bow assembly 140 is mounted to the beam 110 at the first beam end 117. The bow assembly 140 may comprise a riser 142 engaged with the barrel 114. The riser 142 may operatively engage both a first limb assembly 150, and a second limb assembly 160, to the beam 110. The bow assembly 140 may further comprise a first power cord 146, a second power cord 148, and a bow string 144.

The first limb assembly 150 comprises an elongated first limb 151 defining a first end 152 and a second end 155 offset from the first end 152 by the length L1 of the elongated first limb 151. The first limb assembly 150 is rotatably engaged to the riser 142 at a first axis 154 proximate to the first end 152. The first end 152, may also be referred to herein as the proximate end 152 of the first limb 151. The first limb assembly 150 further comprises a first power cord mount 158. The first limb assembly 150 further comprises a first cam 156 rotatably engaged with the first limb 151 at a first cam mount point 159 between the first axis 154 and the first power cord mount 158 and substantially offset from each. In some embodiments the first cam 156 is rotatably engaged with the first limb 151 at a first cam mount point 159 midway between the first axis 154 and the first power cord mount 158. In some embodiments, the first cam 156 is rotatably engaged with the first limb 151 at a first cam mount point 159 offset from the proximate end 152 of the first limb by a length between (0.15)L1 and (0.75)L1.

The second limb assembly 160 comprises an elongated second limb 161 defining a first end 162 and a second end 165 offset from the first end 162 by the length L2 of the elongated second limb 161. The second limb assembly 160 is rotatably engaged to the riser 142 at a second axis 164 proximate to the first end 162. The first end 162, may also be referred to herein as the proximate end 162 of the second limb 161. The second limb assembly 160 further comprises a second power cord mount 168. The first limb assembly 160 further comprises a second cam 166 rotatably engaged with the second limb 161 at a second cam mount point 169 between the second axis 164 and the second power cord mount 168 and substantially offset from each. In some embodiments, the second cam 166 is rotatably engaged with the second limb 161 at a second cam mount point 169 offset from the proximate end 162 of the second limb by a length between (0.15)L2 and (0.75)L2.

The bow string 144 may be operatively engaged between the first cam 156 and the second cam 166. The first power cord 146 may be operatively engaged between the first power cord mount 158 and the second cam 166. The second power cord 148 may be operatively engaged between the second power cord mount 168 and the first cam 156. The bow limbs 151, 161 define opposite ends of the bow assembly 140. In some embodiments, the first power cord mount 158 is offset from the proximate end of the first limb 152 by a length of greater than (0.75)L1. In some embodiments, the second power cord mount 168 is offset from the proximate end of the second limb 162 by a length of greater than (0.75)L2.

Location of the first cam 156 between the first axis 154 and the first power cord mount 158, or location of the second cam 166 between the second axis 164 and the second power cord mount 168 may permit the designer additional latitude in providing desirable performance, size and weight.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A mid-limb cam crossbow system 100 comprising:

an elongated beam 110 having a first beam end 117, and a second beam end 118 opposite the first beam end 117;

a bow assembly 140 mounted to the beam 110 at the first beam end 117, the bow assembly 140 having a pair of limbs 151, 161 defining opposite ends of said bow assembly 140, the pair of limbs 151, 161 being a first limb 151 and a second limb 161, wherein the first limb 151 has a proximate end 152 and a distal end 155 offset from the proximate end 152 by a length L1, and the second limb 161 has a proximate end 162 and a distal end 165 offset from the proximate end 162 by a length L2;

a first cam 156 rotatably engaged with the first limb 151 at a first cam mount point 159 offset from the proximate end of the first limb 152 by a length between (0.15)L1 and (0.75)L1;

a second cam rotatably engaged with the second limb at a second cam mount point 169 offset from the proximate end of the second limb 162 by a length between (0.15)L2 and (0.75)L2;

a first power cord 146 operatively engaged between a first power cord mount 158 and the second cam 166, wherein the first power cord mount 158 is offset from the proximate end of the first limb 152 by a length of greater than (0.75)L1;

a second power cord 144 operatively engaged between a second power cord mount 168 and the first cam 156, wherein the second power cord mount 168 is offset from the proximate end of the second limb 162 by a length of greater than (0.75)L2;

a bow string adapted to propel an arrow, the bowstring operatively engaged between the first cam and the second cam; and wherein the bow assembly may be configured in a) an uncocked configuration in which, i) the bow assembly stores some residual energy, ii) the bowstring is located at a uncocked bowstring position along the main beam; or b) a cocked configuration in which, i) the bow assembly stores more than 75 foot pounds of energy greater than the residual energy, ii) the bowstring is located at a cocked bowstring position along the main beam which is more than 20 centimeters from the uncocked bowstring position; and wherein L1 is between 15 centimeters and 65 centimeters, and L2 is between 15 centimeters and 65 centimeters.

2. The mid-limb cam crossbow system of claim 1, wherein L1 is between 25 centimeters and 55 centimeters, and L2 is between 25 centimeters and 55 centimeters;

wherein, in the cocked configuration, the bow assembly stores more than 95 foot pounds of energy greater than the residual energy; and wherein the cocked bowstring position along the main beam which is more than 25 centimeters from the uncocked bowstring position.

3. The mid-limb cam crossbow system of claim 2, wherein the first pivot point is offset from the proximate end of the first bow limb by a length between (0.30)L1 and (0.70)L1; and wherein the second pivot point is offset from the proximate end of the second bow limb by a length between (0.30)L2 and (0.70)L2.

4. The mid-limb cam crossbow system of claim 3, wherein the first power string is operatively engaged between the first cam and a region on the second bow limb offset from the proximate end of the second bow limb by a length of greater than (0.80)L2; and wherein the second power string is operatively engaged between the second cam and a region on the first bow limb offset from the proximate end of the first bow limb by a length of greater than (0.80)L1.

5. The mid-limb cam crossbow system of claim 1, wherein L1 is between 35 centimeters and 45 centimeters, and L2 is between 35 centimeters and 45 centimeters;

wherein, in the cocked configuration, the bow assembly stores more than 115 foot pounds of energy greater than the residual energy; and wherein the cocked bowstring position along the main beam which is more than 30 centimeters from the uncocked bowstring position.

6. The mid-limb cam crossbow system of claim 5, wherein the first pivot point is offset from the proximate end of the first bow limb by a length between (0.4)L1 and (0.6)L1; and wherein the second pivot point is offset from the proximate end of the second bow limb by a length between (0.4)L2 and (0.6)L2.

7. The mid-limb cam crossbow system of claim 6, wherein the first power string is operatively engaged between the first cam and a region on the second bow limb offset from the proximate end of the second bow limb by a length of greater than (0.85)L2; and wherein the second power string is operatively engaged between the second cam and a region on the first bow limb offset from the proximate end of the first bow limb by a length of greater than (0.85)L1.

8. The mid-limb cam crossbow system of claim 1, wherein L1 is between 30 centimeters and 40 centimeters, and L2 is between 30 centimeters and 40 centimeters;

wherein, in the cocked configuration, the bow assembly stores more than 135 foot pounds of energy greater than the residual energy; and wherein the cocked bowstring position along the main beam which is more than 40 centimeters from the uncocked bowstring position;

wherein a second angle is defined by a vector along the uncocked bowstring position, and a vector along the first power string in the uncocked configuration; and wherein the second angle is between 0 and 30 degrees.

9. The mid-limb cam crossbow system of claim 8, wherein the first pivot point is offset from the proximate end of the first bow limb by a length between (0.45)L1 and (0.55)L1; and wherein the second pivot point is offset from the proximate end of the second bow limb by a length between (0.45)L2 and (0.55)L2.

10. The mid-limb cam crossbow system of claim 9, wherein the first power string is operatively engaged between the first cam and a region on the second bow limb offset from the proximate end of the second bow limb by a length of greater than (0.90)L2; and wherein the second power string is operatively engaged between the second cam and a region on the first bow limb offset from the proximate end of the first bow limb by a length of greater than (0.90)L1.

11. A method of using a mid-limb cam crossbow system comprising:

providing a mid-limb cam crossbow system having an elongated main beam having a first beam end, and a second beam end opposite the first beam end, a bow assembly mounted to the main beam at the first beam end, the bow assembly having a pair of bow limbs defining opposite ends of said bow assembly, the pair of bow limbs being a first bow limb and a second bow limb, wherein the first bow limb has a proximate end and a distal end offset from the proximate end by a length L1, and the second bow limb has a proximate end and a distal end offset from the proximate end by a length L2, a first cam rotatably engaged with the first bow limb at a first pivot point offset from the proximate end of the first bow limb by a length between (0.15)L1 and (0.75)L1;

a second cam rotatably engaged with the second bow limb at a second pivot point offset from the proximate end of the second bow limb by a length between (0.15)L2 and (0.75)L2, a first power string operatively engaged between the first cam and a region on the second bow limb offset from the proximate end of the second bow limb by a length of greater than (0.75)L2, a second power string operatively engaged between the second cam and a region on the first bow limb offset from the proximate end of the first bow limb by a length of greater than (0.75)L1, a bowstring adapted to propel an arrow, the bowstring operatively engaged between the first cam and the second cam, and wherein the bow assembly may be configured in a) an uncocked configuration in which, i) the bow assembly stores some residual energy, ii) the bowstring is located at a uncocked bowstring position along the main beam, or b) a cocked configuration in which, i) the bow assembly stores more than 75 foot pounds of energy greater than the residual energy, ii) the bowstring is located at a cocked bowstring position along the main beam which is more than 20 centimeters from the uncocked bowstring position, and wherein L1 is between 15 centimeters and 65 centimeters, and L2 is between 15 centimeters and 65 centimeters;

changing the bow assembly from a uncocked configuration to a cocked configuration by an operation comprising the steps of a) moving the bowstring from the uncocked bowstring position to the cocked bowstring position, and b) storing energy in the bow assembly of more than 75 foot pounds of energy greater than the residual energy.

12. The method of using a mid-limb cam crossbow system of claim 11, wherein L1 is between 25 centimeters and 55 centimeters, and L2 is between 25 centimeters and 55 centimeters;

wherein, in the cocked configuration, the bow assembly stores more than 95 foot pounds of energy greater than the residual energy; and wherein the cocked bowstring position along the main beam which is more than 25 centimeters from the uncocked bowstring position.

13. The method of using a mid-limb cam crossbow system of claim 12, wherein the first pivot point is offset from the proximate end of the first bow limb by a length between (0.30)L1 and (0.70)L1; and wherein the second pivot point is offset from the proximate end of the second bow limb by a length between (0.30)L2 and (0.70)L2.

14. The method of using a mid-limb cam crossbow system of claim 13, wherein the first power string is operatively engaged between the first cam and a region on the second bow limb offset from the proximate end of the second bow limb by a length of greater than (0.80)L2; and wherein the second power string is operatively engaged between the second cam and a region on the first bow limb offset from the proximate end of the first bow limb by a length of greater than (0.80)L1.

15. The method of using a mid-limb cam crossbow system of claim 11, wherein L1 is between 30 centimeters and 40 centimeters, and L2 is between 30 centimeters and 40 centimeters;

wherein, in the cocked configuration, the bow assembly stores more than 135 foot pounds of energy greater than the residual energy; and wherein the cocked bowstring position along the main beam which is more than 40 centimeters from the uncocked bowstring position.

16. The method of using a mid-limb cam crossbow system of claim 15, wherein the first pivot point is offset from the proximate end of the first bow limb by a length between (0.45)L1 and (0.55)L1; and wherein the second pivot point is offset from the proximate end of the second bow limb by a length between (0.45)L2 and (0.55)L2.

17. The method of using a mid-limb cam crossbow system of claim 16, wherein the first power string is operatively engaged between the first cam and a region on the second bow limb offset from the proximate end of the second bow limb by a length of greater than (0.90)L2; and wherein the second power string is operatively engaged between the second cam and a region on the first bow limb offset from the proximate end of the first bow limb by a length of greater than (0.90)L1.

18. The method of using a mid-limb cam crossbow system of claim 17, wherein a second angle is defined by a vector along the uncocked bowstring position, and a vector along the first power string in the uncocked configuration;

wherein the second angle is between 0 and 30 degrees.

19. A mid-limb cam crossbow system comprising:

an elongated main beam having a first beam end, and a second beam end opposite the first beam end;

a bow assembly mounted to the main beam at the first beam end, the bow assembly having a pair of bow limbs defining opposite ends of said bow assembly, the pair of bow limbs being a first bow limb and a second bow limb, wherein the first bow limb has a proximate end and a distal end offset from the proximate end by a length L1, and the second bow limb has a proximate end and a distal end offset from the proximate end by a length L2;

a first cam rotatably engaged with the first bow limb at a first pivot point offset from the proximate end of the first bow limb by a length between (0.45)L1 and (0.55)L1;

a second cam rotatably engaged with the second bow limb at a second pivot point offset from the proximate end of the second bow limb by a length between (0.45)L2 and (0.55)L2;

a first power string operatively engaged between the first cam and a region on the second bow limb offset from the proximate end of the second bow limb by a length of greater than (0.90)L2;

a second power string operatively engaged between the second cam and a region on the first bow limb offset from the proximate end of the first bow limb by a length of greater than (0.90)L1;

a bowstring adapted to propel an arrow, the bowstring operatively engaged between the first cam and the second cam; and wherein the bow assembly may be configured in a) an uncocked configuration in which, i) the bow assembly stores some residual energy, ii) the bowstring is located at a uncocked bowstring position along the main beam; or b) a cocked configuration in which, i) the bow assembly stores more than 135 foot pounds of energy greater than the residual energy, ii) the bowstring is located at a cocked bowstring position along the main beam which is more than 40 centimeters from the uncocked bowstring position; and wherein L1 is between 32 centimeters and 38 centimeters, and L2 is between 32 centimeters and 38 centimeter;

wherein a second angle is defined by a vector along the uncocked bowstring position, and a vector along the first power string in the uncocked configuration; and wherein the second angle is between 15 and 30 degrees.

20. The mid-limb cam crossbow system of claim 19 wherein, L1 differs from L2 by at least 3 centimeters.

* * * * *